US005557252A

United States Patent [19]

Ariyoshi

[11] Patent Number: 5,557,252

[45] Date of Patent: Sep. 17, 1996

[54] THICK FILM CIRCUIT BOARD AND METHOD OF MANUFACTURING THE SAME

[75] Inventor: Shogo Ariyoshi, Itami, Japan

[73] Assignee: Mitsubishi Denki Kabushiki Kaisha, Tokyo, Japan

[21] Appl. No.: 239,968

[22] Filed: May 9, 1994

[30] Foreign Application Priority Data

May 13, 1993 [JP] Japan ..... 5-111628

[51] Int. Cl.[6] ..... H01C 1/12

[52] U.S. Cl. ..... 338/195; 338/308; 338/309; 338/314; 361/766

[58] Field of Search ..... 338/195, 306, 338/307, 308, 309, 314, 320; 174/52.4; 361/749, 765, 766; 219/121.69

[56] References Cited

U.S. PATENT DOCUMENTS

| | | | |
|---|---|---|---|
| 4,439,754 | 3/1984 | Madden, Jr. | 338/320 |
| 4,580,030 | 4/1986 | Takeuchi | 219/121.69 |
| 5,087,961 | 2/1992 | Long et al. | 174/52.4 |
| 5,168,430 | 12/1992 | Nitsch et al. | 361/398 |
| 5,253,010 | 10/1993 | Oku et al. | 174/52.4 |

FOREIGN PATENT DOCUMENTS

| | | | |
|---|---|---|---|
| 2651923A | 3/1991 | France . | |
| 62-92331 | 4/1987 | Japan . | |
| 1-161840 | 6/1989 | Japan | 361/749 |

*Primary Examiner*—Teresa J. Walberg
*Assistant Examiner*—Raphael Valencia
*Attorney, Agent, or Firm*—Leydig, Voit & Mayer

[57] ABSTRACT

A thick film circuit board includes a substrate, a thick film resistor on the substrate and having a trimming region and a protecting element on the substrate for protecting the thick film resistor and having a window through which the trimming region is exposed. The protecting element may be a protective coating disposed on the substrate. Alternatively, the protective element may be a protective frame extending along an external periphery of a region where the thick film resistor is located on the substrate and having a height for protecting the thick film resistor from mechanical damage.

5 Claims, 6 Drawing Sheets

THICK FILM CIRCUIT BOARD AND METHOD OF MANUFACTURING THE SAME

BACKGROUND OF THE INVENTION

The present invention relates to a thick film circuit board and more particularly, to a thick film circuit board having a thick film resistor thereon. The present invention also relates to a method of manufacturing the thick film circuit.

FIGS. 9 to 12 are perspective views showing a known process of manufacturing a known thick film circuit board. As shown in FIG. 9, wiring electrodes 2 are formed on a substrate 1 made of, for example, ceramic by a printing and baking method. An electrically conductive material including silver and palladium is used for the wiring electrodes 2. As shown in FIG. 10, a thick film resistor 3 is printed and baked in such a manner that the resistor 3 is connected to the and bridges the two wiring electrodes 2. Ruthenium oxide is used for the thick film resistor 3. Since the resistance of the thick film resistor 3 depends upon the material, width, length and thickness of the thick film resistor 3, the resistance can be designed on the basis of them. As shown in FIG. 11, an overcoat 4 made of glass having a low melting point coats the entire surface of the substrate 1 excluding portions to be exposed outside on which elements are mounted. As the wiring electrodes 2 are made of an electrically conductive material, if water intrudes into the wiring electrodes 2, silver in the wiring electrodes 2 is ionized, so that an undesirable electrical path is occasionally established between the wiring electrodes 2. This is referred to as "migration" between wiring electrodes. The overcoat 4 is formed mainly for preventing the migration between the wiring electrodes 2, i.e., preventing the thick film circuit board from being electrically damaged. However, because the overcoat 4 is fragile as a characteristic of glass and weak against an external mechanical force, the thick film resistor 3 is often damaged when it is hit against something. In this meaning, the overcoat 4 is insufficient to protect the thick film resistor 3 from mechanical damage.

As described above, the thick film resistor 3 is formed by the printing and baking method. Therefore, the resistance of the thick film resistor 3 after the printing and baking changes greatly depending upon the deviation of thickness or width and the unevenness of material during the printing. For this reason, the thick film resistor 3 has been printed in such a manner that the resistor 3 has a resistance smaller than a target resistance and then a part of the thick film resistor 3 is heated and vaporized by a laser beam and removed together with the overcoat 4 such that the resistance increases gradually, so that the resistance of the resistor 3 can be adjusted to match to the target resistance. The adjusting process of the resistance of the thick film resistor 3 is referred to as the "trimming process". FIG. 12 shows a trimming trace 3*a*. The trimming process is classified into two types. In one type of trimming process, the resistance of the thick film resistor 3 is adjusted before an assembly process considering only the resistance of resistor 3. In another type of trimming process, the resistance of the thick film resistor 3 is adjusted while the output characteristic of all or part of a circuit on the substrate 1 is measured and monitored so that the deviation of characteristic of mounted elements can be eliminated, after a semiconductor element is mounted on the substrate 1 in the assembly process. The other type of trimming process is referred specifically to as "function trimming". As another trimming method, there is a sand trimming method in which silicon powder is sprayed with compressed air to scour the resistor 3.

The known thick film circuit board is structured and manufactured as described above and the resistance of the thick film resistor 3 is adjusted to proper target value. However, when a damage 3*b* is given to the surface of the thick film resistor 3 later, as shown in FIG. 13, the resistance changes, resulting in a faulty part. Specifically, in a case that a high precision is required, little damage also has a great effect.

In a manufacturing process after the trimming process, a plurality of substrates 1 are individually put into slits in a stand such that they are arranged and transferred in the standing state. In this case, when one of the plurality of substrates 1 falls on an adjacent substrate 1, if the edge of the fallen substrate 1 strikes the surface of the thick film resistor 3 of the adjacent substrate 1, the surface of the adjacent substrate 1 is damaged because a material having a great hardness, such as ceramic, is mainly used for the substrate 1, as described above.

Also, in the manufacturing process, a plurality of substrates 1 are arranged on a flat plate in a horizontal state and in a matrix. In this case, if the flat plate collides with something and receives a force, some of the plurality of substrates 1 located on the flat plate in the horizontal state often move onto adjacent substrates 1. At this time, if the edge of the substrate 1 strikes the surface of the thick film resistor 3 of another adjacent substrate 1, the adjacent substrate 1 is also damaged.

Recently, a thick film circuit board has been developed to have the structure in which circuits are arranged on the front and back surfaces as shown in FIGS. 14 and 15, i.e., the structure in which parts such as a chip element 5*a* and a semiconductor element 5*b* are arranged on the front surface of the substrate 1 while the thick film resistor 3 is arranged on the back surface, and a through hole 1*a* is provided in the substrate 1 to electrically connect between wiring electrodes 2 on both the front and back surfaces of the substrate 1. In such a structure of the thick film circuit board, the substrate 1 is put on the surface of a plate such that the back surface of the substrate 1 is in contact with the plate surface. When there is something undesirable on the plate surface, the thick film resistor 3 is scoured damaged. In a case where a plurality of substrates 1 having the above structure are put into slits of a stand in a vertical state and transferred as described above, if one substrate 1 falls on another adjacent substrate 1 so that an element mounted thereon strikes the surface of the thick film resistor 3 mounted on the back surface of the other adjacent substrate 1, the resistor 3 is often damaged. As described above, in the thick film circuit substrate 1 of the structure in which the thick film resistor 3 is arranged on the back surface of the substrate 1, because there is a high probability that something like a contaminant will strike the thick film resistor 3 mounted on the back surface of the substrate 1, the thick film resistor 3 is possibly damaged. Thus, a new problem is caused in that a fault in the thick film resistor 3 is caused by mechanical damage in many cases.

In order to prevent the thick film resistor 3 from being damaged, it could be considered to overcoat the whole thick film resistor 3. However, when the overcoat is thin, the protection against an external mechanical force is not sufficient. Thus, a thick overcoat is required. In this case, however, laser beam or silicon powder trimming is resisted by the thick overcoat and satisfactory trimming cannot be performed. In addition, products employing a heat resisting ceramic substrate 1 are used in many cases under great temperature change, such as in the engine compartment of an automobile. When the overcoat is thick, the thermal stress of the overcoat is greater. A large temperature change in a connecting portion of the thick film resistor 3 may peel the resistor 3 from the substrate 1.

SUMMARY OF THE INVENTION

Accordingly, one object of the present invention is to provide a thick film circuit board free from the above-discussed problems of the known thick film circuit board.

Another object of the present invention is to provide a thick film circuit board in which a thick film resistor 3 is protected from mechanical damage and achieves a good trimming result, without peeling the thick film resistor 3 from a substrate 1.

In order to achieve the above object, a thick film circuit board of the present invention comprises a substrate, a thick film resistor provided on the substrate and having a trimming processing region in which trimming processing is to be performed and protecting means provided on the substrate for protecting the thick film resistor and having a window through which the trimming processing region is exposed.

The protecting means may comprise a protective coat and the window of the protecting means may expose the trimming processing region and its peripheral region. The protecting means also may comprise a protective frame extending along an external periphery of a region where the thick film resistor is provided on said substrate and having a height for protecting said thick film resistor from mechanical damage.

The present invention also resides in a method for manufacturing the thick film circuit board.

In the thick film circuit substrate of the present invention, since there is provided a window for exposing a trimming processing region of the thick film resistor and a protecting means for protecting the thick film resistor from mechanical damage, the trimming processing region is therefore exposed. Thus the trimming processing can be achieved in a good condition and, further, the thick film resistor can be prevented from being damaged after the trimming processing. Alternatively, the protecting means may be provided for the whole surface of thick film resistor after the trimming processing is performed for the thick film resistor. In this case, since there is no protecting means in the trimming process, the trimming processing can be achieved with a good result. Also, in this case, as the thick film resistor is protected by the protecting means after the trimming process, the thick film resistor is not damaged.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
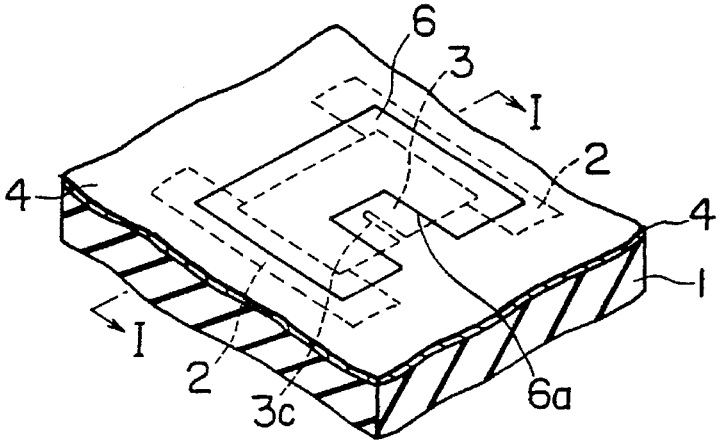
FIG. 1 is a fragmentary perspective view of an embodiment of a thick film circuit board of the present invention.
Figure 2:
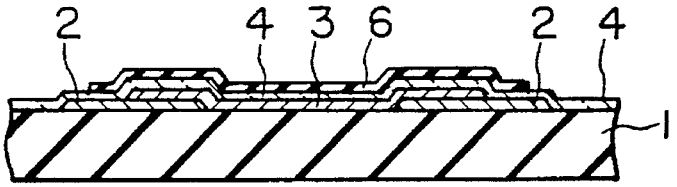
FIG. 2 is a sectional view of the thick film circuit board taken along the line I—I shown in FIG. 1.

FIG. 1 shows a fragmentary perspective view of the thick film circuit board according to an embodiment of the present invention and FIG. 2 shows a cross section of the thick film circuit board taken along the line I—I of FIG. 1. This thick film circuit board is the most suitable for use in a pressure sensor which is used together with an internal combustion engine. In FIG. 1 and 2, wiring electrodes 2 made of electrically conductive material including silver and palladium is provided on a substrate 1 made of, for example, ceramic by a printing and baking method. A thick film resistor 3 made of ruthenium oxide is printed and baked such that the resistor 3 is connected to the two wiring electrodes 2 bridges the two wiring electrodes 2. As described above, the thick film resistor 3 is printed such that the resistor 3 has a resistance smaller than a predetermined resistance and then is trimmed so that the resistance of the resistor 3 can be adjusted to match the predetermined resistance. A trimming processing region 3*c* is shown in FIG. 1 by a phantom line. An overcoat 4 made of glass having a low melting point coats the entire surface of the substrate 1 in such a manner that the wiring electrodes 2 and the thick film resistor 3 are covered. In this embodiment, further, a protective coat 6 made of epoxy resin is on a portion on the overcoat 4 which corresponds to a region of the thick film resistor 3 except for the trimming processing region 3*c*, as a means for protecting the thick film resistor 3 from mechanical damage. In other words, the protective coat 6 has a window 6*a* exposing the trimming processing region 3*c* through the overcoat 4. The size of the window 6*a* should be sufficient to protect the thick film resistor 3 from mechanical damage, to enable a free adjustment of the resistenace of the resistor 3 in a high precision in trimming, to cope with a position deviation in applying the protective coat, and a position deviation of, for example a laser beam in trimming. The resistance of the thick film resistor 3 can be freely adjusted with a high precision.

Figure 3:
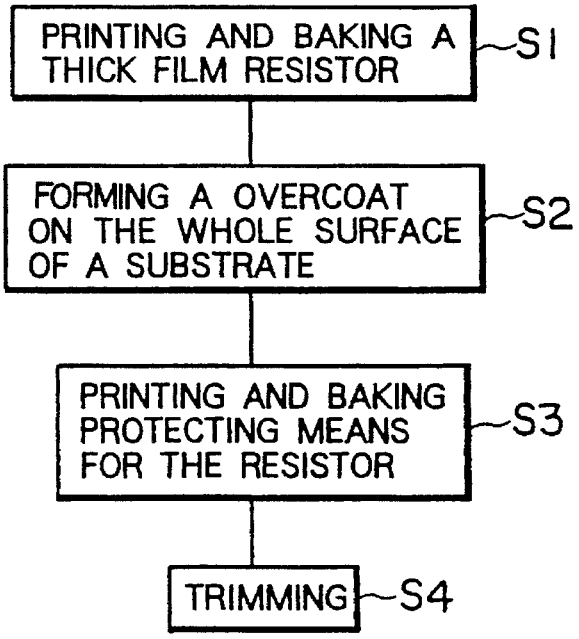
FIG. 3 is a flow chart showing a manufacturing process of the embodiments shown in FIGS. 1, 4 and 6.

Next, a manufacturing method will be described. A flow chart of the manufacturing process is shown in FIG. 3. In the embodiment shown in FIG. 1, after a process S1 of FIG. 3 where the thick film resistor 3 and the wiring electrodes 2 are printed and baked on the substrate 1, similar to the known method shown in FIG. 11, a process S2 of FIG. 3 is performed in which the overcoat 4 of glass having a low melting point is formed on the entire surface of the substrate 1 except for a surface region necessary for exposure. Then, as shown in FIG. 1, the process S3 of FIG. 3 is performed in which the protective coat 6, the second overcoat, is formed on the overcoat 4, covering the entire region where the thick film resistor 3 is formed, other than the trimming processing region 3*c* for the resistor 3 and the peripheral region thereof, based on the well known printing and baking method as disclosed in Japanese Patent Laid Open No. 4-259250. A material having a sufficient hardness after hardening, such as epoxy resin, is used as the material of the protective coat 6. As for the thickness of the protective coat 6, the protective coat 6 is applied in the embodiment in such a manner that the thick film resistor 3 is sufficiently protected from an external mechanical force without peeling or separating because of thermal stress.

According to an experiment, the thickness of the protective coat 6 is preferable about 20 to 30 microns. By repeating the well known printing and baking method as described above, if necessary, the protective coat 6 can easily have a predetermined thickness. The overcoat 4 is formed for preventing migration between the wiring electrodes 2, which is electrical damage of the thick film circuit board caused by intrusion of water, as described above. However, because the overcoat 4 is made of glass and weak against an external mechanical force because of the contact with a contaminant, the overcoat 4 is not useful for protection of the thick film resistor 3 from mechanical damage. For this reason, in this embodiment, the protective coat 6 is provided so that the thick film resistor 3 is protected from the mechanical damage.

After the protective coat 6 is formed, in a process S4 of FIG. 3, which shows a trimming process of the thick film resistor 3, the trimming processing region 3*c* of the thick film resistor 3 is heated and vaporized by a laser beam with the overcoat 4 and removed. As a result, the resistance of the resistor 3 increases gradually so that it can be adjusted to the predetermined value. In embodiment, because the protective coat 6 excludes the trimming processing region 3*c* and its peripheral region, the trimming processing can be performed in quite the same manner as in the known method. As for the trimming method, the sand trimming method may be used as well as the laser trimming method. The trimming processing may be performed taxing only the resistance of the thick film resistor 3 into account. However, the trimming processing may be performed while measuring the output characteristic of all or part of a circuit on the substrate 1. As described above, in the thick film circuit board of the embodiment, because all of the thick film resistor 3 is coated with the protective coat 6, other than the trimming processing region 3*c* and its peripheral region of the thick film resistor 3, the trimming processing can be performed efficiently and precisely. In addition, even if another substrate 1 falls and strikes the surface of the substrate 1, the thick film resistor 3 is protected by the protective coat 6 and is not damaged, as described above. Further, the thick film resistor 3 never peels due to thermal stress of the protective coat 6. In addition, the thick film resistor 3 is protected from external mechanical forces, since the protective coat 6 has a thickness sufficient to resist to an external mechanical force.

Figure 12:
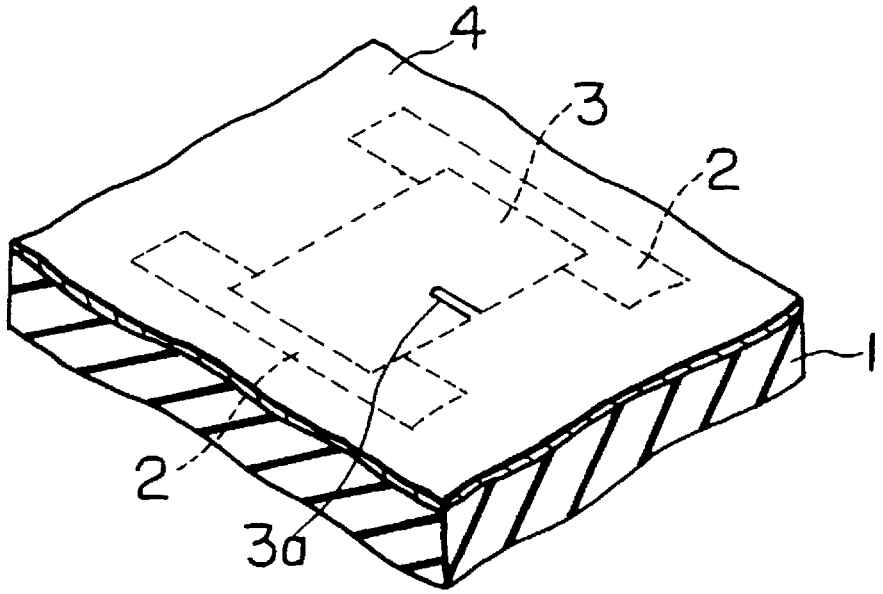
FIG. 12 is a fragmentary perspective view of the known thick film circuit board when trimming processing is performed for the thick film circuit board shown in FIG. 9 during the manufacturing process.
Figure 13:
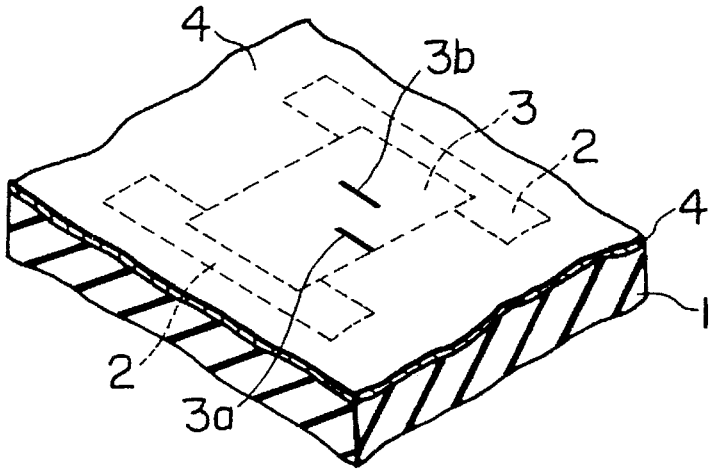
FIG. 13 is a fragmentary perspective view of the known thick film circuit board when the thick film resistor on the thick film circuit board is damaged.
Figure 14:
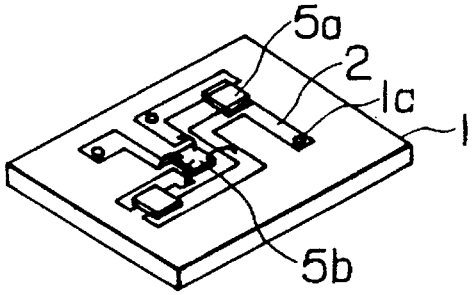
FIG. 14 is a perspective view showing a surface of a known thick film circuit board having circuits on both surfaces of the substrate.
Figure 15:
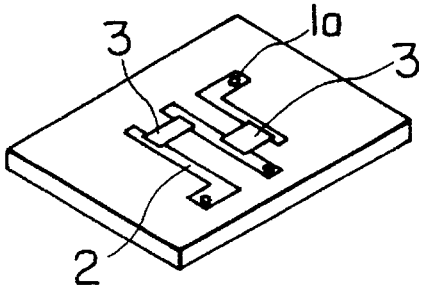
FIG. 15 is a perspective view showing the back surface of the thick film circuit board shown in FIG. 14.

The size of the whole substrate 1 is about 25× about 13 mm (1×0.5 inch) while the size of the thick film resistor 3 is about 2×3 mm. Therefore, the region of the thick film resistor 3 on which the protective coat 6 is not formed, namely the window 6*a*, is very small compared with the substrate 1. In addition, because this small region is recessed relative to the protective coat 6, it is almostly never struck by the edge of another substrate 1. Even if there is damage by striking, because the trimming processing region 3*c* is trimmed such that a current flowing around the region 3*c* is very small, the influence is small so that the characteristics of the whole circuit are not changed. Further, even in a case of the structure 1 in which the thick film resistor 3 is provided on the back surface of the substrate 1 as shown in FIG. 12, the thick film resistor 3 is protected by a protective coat 6 not contacting a base plane, so that the resistor 3 is never damaged.

In the above embodiment, the overcoat 4 is provided to prevent migration between the wiring electrodes 2, i.e., electrical damage. However, the overcoat 4 is not necessarily required and the present invention can be applied to a thick film circuit board having basically the same structure as that of the above embodiment but with no overcoat 4.

Figure 4:
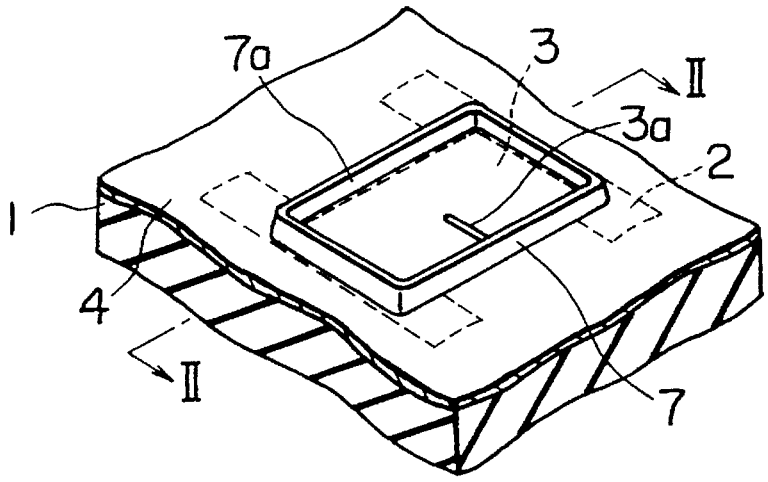
FIG. 4 is a fragmentary perspective view of another embodiment of a thick film circuit board of the present invention.
Figure 5:
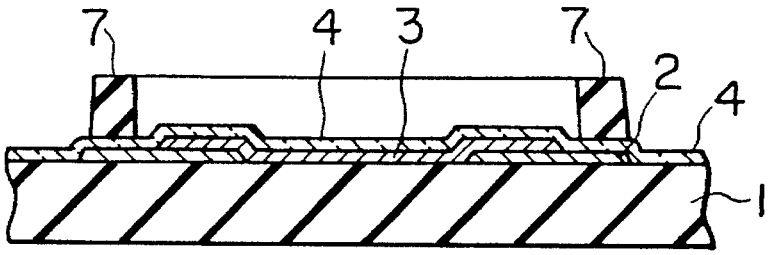
FIG. 5 is a sectional view of the thick film circuit board taken along the line II—II shown in FIG. 4.

FIGS. 4 and 5 show another embodiment of the thick film circuit board of the present invention. FIG. 5 is a cross section of the substrate taken along line II—II in FIG. 4. In this embodiment, as shown in FIGS. 4 and 5, a protection frame 7 made, for example of cross glass and having a height sufficient to protect the thick film resistor 3 from mechanical damage is arranged along the outer circumference of a region on the overcoat 4 where the thick film resistor 3 is formed. The overcoat 4 is made of glass having a low melting point. The protection frame 7 as a protecting means having a window 7*a* for exposing a portion of the overcoat 4 corresponding to substantially the whole of the thick film resistor 3, including a trimming trace 3*a* for trimming processing in the trimming processing region 3*c* (see FIG. 1). The structure of the other portions is the same as that of the embodiment shown in FIG. 1. Therefore, the description is omitted by assigning the same reference numerals to the same components.

Figure 11:
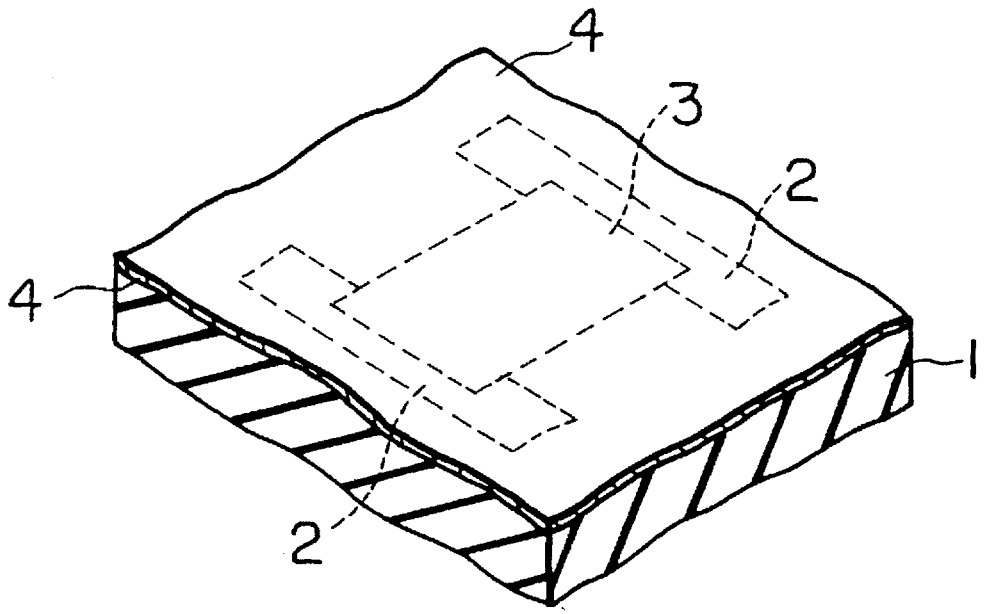
FIG. 11 is a fragmentary perspective view of the known thick film circuit board when a overcoat made of a glass material is applied to almost the whole surface of the thick film circuit board shown in FIG. 8 during the manufacturing process.

Next, the manufacturing method will be described below. The flow chart of the manufacturing process is the same as in the embodiment shown in FIG. 1, which is shown in FIG. 3. First, as shown in the processes S1 and S2 of FIG. 3 similar to the embodiment shown in FIG. 1, the processes are performed with the overcoat 4 made of glass having a low melting point applied over the whole substrate 1 as shown in FIG. 11 in which the known thick film circuit board is shown. Then, as shown in the process S3 of FIG. 3, the protection frame 7 is provided along the outer circumference of the thick film resistor 3 surrounding the resistor 3 as shown in FIG. 4. A material having a relatively high strength and hardness such as cross glass is used for the protection frame 7 which is printed and baked to be fixed on the overcoat 4. The cross glass is an insulating glass composed of crystallized glass which is used to prevent electrical short-circuiting between wiring electrodes when the wiring electrodes cross to each other. If a metallic mask is used as a mask in printing and baking the cross glass to form the protection frame 7, a protection frame 7 up to 100 microns in height can be easily formed. Because the thicknesses of the wiring electrodes 2 and the thick film resistor 3 are about 9 to 13 microns and the thickness of the overcoat 4 is about 10 microns, a portion of the protection frame 7 which is formed on the overcoat 4 for the wiring electrodes 2 has a height three times as high as the highest portion of a region where the thick film resistor 3 is formed. After the protection frame 7 is formed, the trimming process of the thick film resistor 3 is performed in the process S4 of FIG. 3. The trimming trace is shown in FIG. 4.

In this embodiment, similar to the embodiment shown in FIG. 1, even if a substrate 1 falls on another adjacent substrate 1, the external mechanical force is resisted by the protection frame 7 so that the thick film resistor 3 is prevented from being damaged. Even in a case of the structure in which the thick film resistor 3 is formed on the back surface of the substrate 1, the external mechanical force is also resisted by the protection frame 7 so that the surface of the thick film resistor 3 is not scoured by a contaminant in direct contact with the surface of the resistor 3. In addition, in the embodiment, because the surface of the thick film resistor 3 is essentially exposed similar to that of the known circuit substrate shown in FIG. 12, the trimming process can be performed to achieve a good result. In order to form the protection frame 7 by printing the cross glass by use of the metallic mask composed of an inner mask and an outer mask, fine hanging pins are used to connect the inner mask and the outer mask at some positions. In this case, the cross glass cannot be printed at such positions, so that some slender gaps appear at such positions in the protection frame 7. However, it is not inconvenient and the thick film resistor 3 can be prevented from mechanical damage, resulting in the same advantage.

Figure 6:
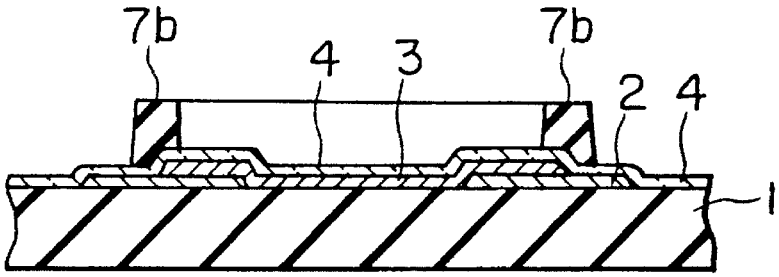
FIG. 6 is a sectional view of still another embodiment of the thick film circuit board of the present invention.

FIG. 6 shows another embodiment, which has basically the same structure as that illustrated in FIGS. 4 and 5 but is different in one point. In this embodiment, the protection frame 7 is located partially on the resistor 3. Even in such a case, the same advantage can be obtained.

In the embodiments shown in FIGS. 4 to 6, because substantially the whole surface of the thick film resistor 3 is covered by only the thin overcoat 4 made of glass but is not covered by any thick overcoat made of thermoplastic resin, the thick film resistor 3 never peels from the substrate 1 because of thermal stress.

Figure 7:
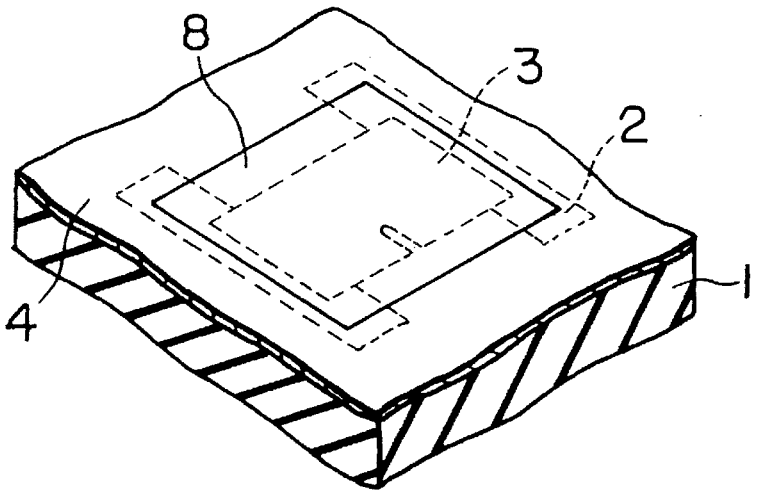
FIG. 7 is a fragmentary perspective view of still another embodiment of a thick film circuit board of the present invention.

FIG. 7 illustrates still another embodiment of the thick film circuit board of the present invention, in which a protective coat 8 made of a thermoplastic resin covers on the whole region where the thick film resistor 3 is formed on the overcoat 4 made of glass having a low melting point, after the trimming process is performed for the thick film resistor 3 on the substrate 1. The components 1 to 4 in FIG. 7 are the same as that in the embodiment shown in FIG. 1.

Figure 8:
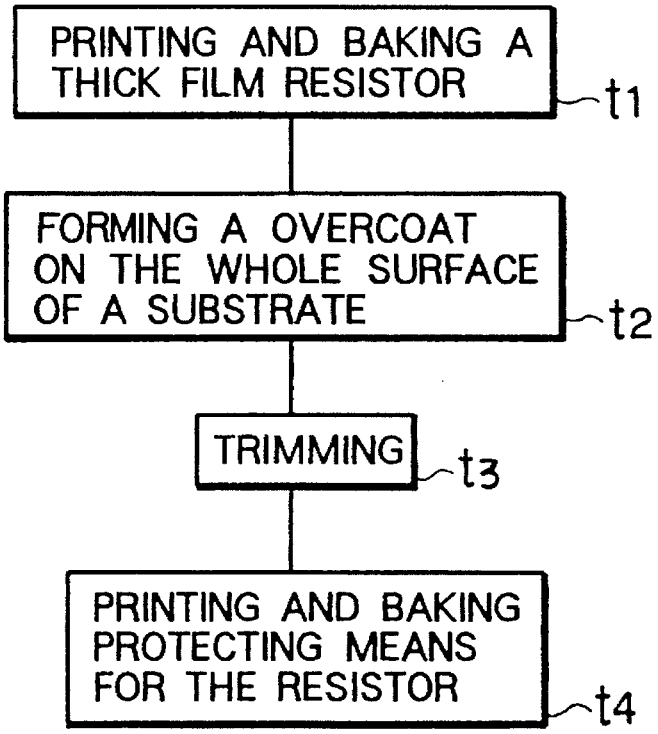
FIG. 8 is a flow chart showing the manufacturing process of the embodiment shown in FIG. 7.
Figure 9:
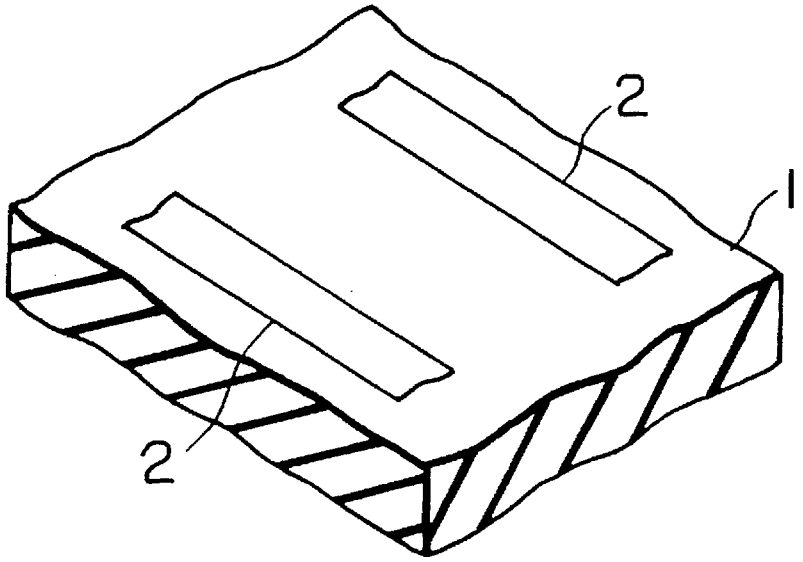
FIG. 9 is a fragmentary perspective view of a known thick film circuit board when wiring electrodes are formed during the manufacturing process.
Figure 10:
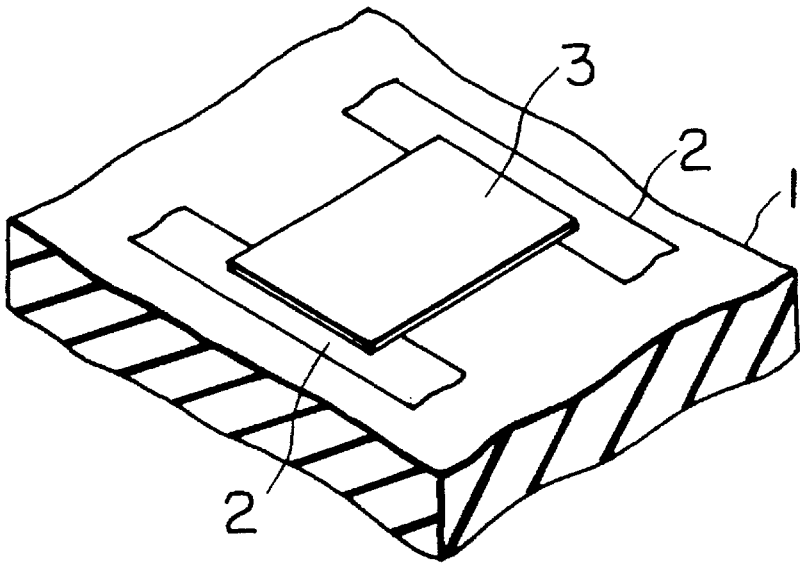
FIG. 10 is a fragmentary perspective view of the known thick film circuit board when a thick film resistor is provided so as to bridge wiring electrodes shown in FIG. 7 during the manufacturing process.

Next, the manufacturing process will be described. FIG. 8 shows the flow chart of the manufacturing process. First, similar to the known thick film circuit board as shown in FIG. 10, the process t1 of FIG. 8 is performed in which the thick film resistor 3 is printed between the wiring electrodes 2. Subsequently, as shown in FIG. 11, a process t2 of FIG. 8 is performed in which the overcoat 4 made of glass having a low melting point is applied to substantially the whole surface of the substrate 1 and then a process t3 of FIG. 8 is performed in which the trimming process is performed for the thick film resistor 3 as shown in FIG. 12. Thereafter, as shown in FIG. 7, a process t4 of FIG. 8 is performed in which the protective coat 8 made of thermoplastic resin is deposited, baked and fixed such that the whole surface of the resistor 3 is covered and protected from an external mechanical force. Since the protective coat 8 is applied after the trimming process, the work efficiency of the trimming process is very good and the resistance of the resistor 3 can be freely adjusted with high precision.

It is preferable to use a thermoplastic resin having a sufficient hardness after hardening as the protective coat. A silicone resin is suitable since it applies almost no thermal stress to the thick film resistor 3. For instance, when it is difficult to control the thickness of the protective coat 8 in the manufacturing process, even if the silicone resin cannot be applied in a thin coat, there is no occasion in which the thick film resistor 3 peels from the substrate 1 because of thermal stress. Therefore, the silicone resin may be relatively thick. Thus, the manufacturing process becomes simpler and can be completed at a low cost. However, the silicone resin is relatively weak itself against an external mechanical force compared to the epoxy resin or cross glass described above and hence it needs to have a thickness to a extent. It is preferably about 200 to 500 microns thick. In this embodiment, the work efficiency is also good so that the resistance of the thick film resistor 3 can be adjusted with high precision. The thick film resistor 3 is protected from an external mechanical force by the protective coat 8, so that the resistor 3 is never damaged and never peels from the substrate 1 because of thermal stress.

As has been described above, in the thick film circuit board of the present invention, the trimming process can be easily performed to achieve a good result and the thick film resistor 3 can be protected sufficiently from an external mechanical force. In addition, by providing the resistor 3 with a protecting means which does not cause peeling of the resistor 3 is because of thermal stress, the thick film resistor 3 can be protected from mechanical damage even in the manufacturing process after the trimming process. The process for forming the protecting means is easy and simple.

What is claimed is:

1. A thick film circuit board comprising:

a substrate;

a thick film resistor disposed on said substrate and having a trimming region;

an overcoat covering all of said substrate and said thick film resistor; and a protective coating disposed on said substrate partially covering and protecting said thick film resistor and having a window through which the trimming region of said thick film resistor is exposed through said overcoat.

2. The thick film circuit board according to claim 1 wherein said protective coating comprises an epoxy resin.

3. The thick film circuit board according to claim 1 wherein said overcoat is a glass.

4. A method of manufacturing a thick film circuit board comprising:

providing on a substrate a thick film resistor having a trimming region;

depositing an overcoat over all of said substrate and said thick film resistor;

forming a protective coating on said overcoat and having a window through which the trimming region is exposed; and trimming said thick film resistor at said trimming region.

5. The method of claim 4 including depositing a glass on said overcoat and depositing an epoxy resin as said protective coating.

* * * * *